United States Patent [19]

Browne

[11] Patent Number: 4,882,884

[45] Date of Patent: Nov. 28, 1989

[54] BUILDING STRUCTURES

[75] Inventor: Antony N. Browne, Eastcombe, United Kingdom

[73] Assignee: Nomad Structures International, Ltd., Stroud, United Kingdom

[21] Appl. No.: 292,909

[22] Filed: Jan. 3, 1989

Related U.S. Application Data

[63] Continuation of Ser. No. 26,762, Mar. 2, 1987, abandoned.

[30] Foreign Application Priority Data

Jul. 8, 1985 [GB] United Kingdom ..... 8517237

[51] Int. Cl.[4] ..... E04B 7/14

[52] U.S. Cl. ..... 52/82; 52/645; 135/106; 135/101; 135/117; 135/97

[58] Field of Search ..... 52/645, 646, 69, 63, 52/280, 80–83; 135/106, 101, 117, 118, 97; 403/171, 172, 176, 217

[56] References Cited

U.S. PATENT DOCUMENTS

| | | | |
|---|---|---|---|
| 1,846,011 | 2/1932 | Adams | 135/117 |
| 2,137,625 | 11/1938 | Norvell | 135/117 |
| 2,433,677 | 12/1947 | Thomas | 52/72 |
| 2,719,384 | 10/1955 | Eames | 136/97 |
| 2,866,235 | 12/1958 | Couse et al. | 52/586 |
| 2,882,564 | 4/1959 | Couse et al. | 52/586 |
| 2,891,491 | 6/1959 | Richter | 52/81 |
| 2,924,858 | 2/1960 | Couse et al. | 52/586 |
| 2,963,031 | 12/1960 | Carroll | 135/109 |
| 3,315,994 | 4/1967 | Rifken | 403/171 |
| 3,376,879 | 4/1968 | Huddle | 135/97 |
| 3,530,663 | 7/1970 | Schertel | 52/738 |
| 3,768,216 | 10/1973 | Shirota et al. | 52/73 |
| 3,810,481 | 5/1974 | Nohmura | 135/101 |
| 4,256,300 | 3/1981 | Boucher | 403/64 |
| 4,673,308 | 6/1987 | Reilly | 402/172 |

FOREIGN PATENT DOCUMENTS

| | | | |
|---|---|---|---|
| 677066 | 6/1939 | Fed. Rep. of Germany | 138/118 |

*Primary Examiner*—James L. Ridgill, Jr.
*Attorney, Agent, or Firm*—Helfgott & Karas

[57] ABSTRACT

A framework module for a modular building structure has a plurality of elongate frame members (10, 11, 12, 13) assembled to form two inverted V-frames oppositely inclined to the vertical, the two frames defining respective faces of first and second imaginary pyramids (19, 20). When two such modules are assembled together, one of the inverted V-frames of the second module defines an adjoining face of either the first or second pyramid defined by the first module.

9 Claims, 6 Drawing Sheets

Fig.7.
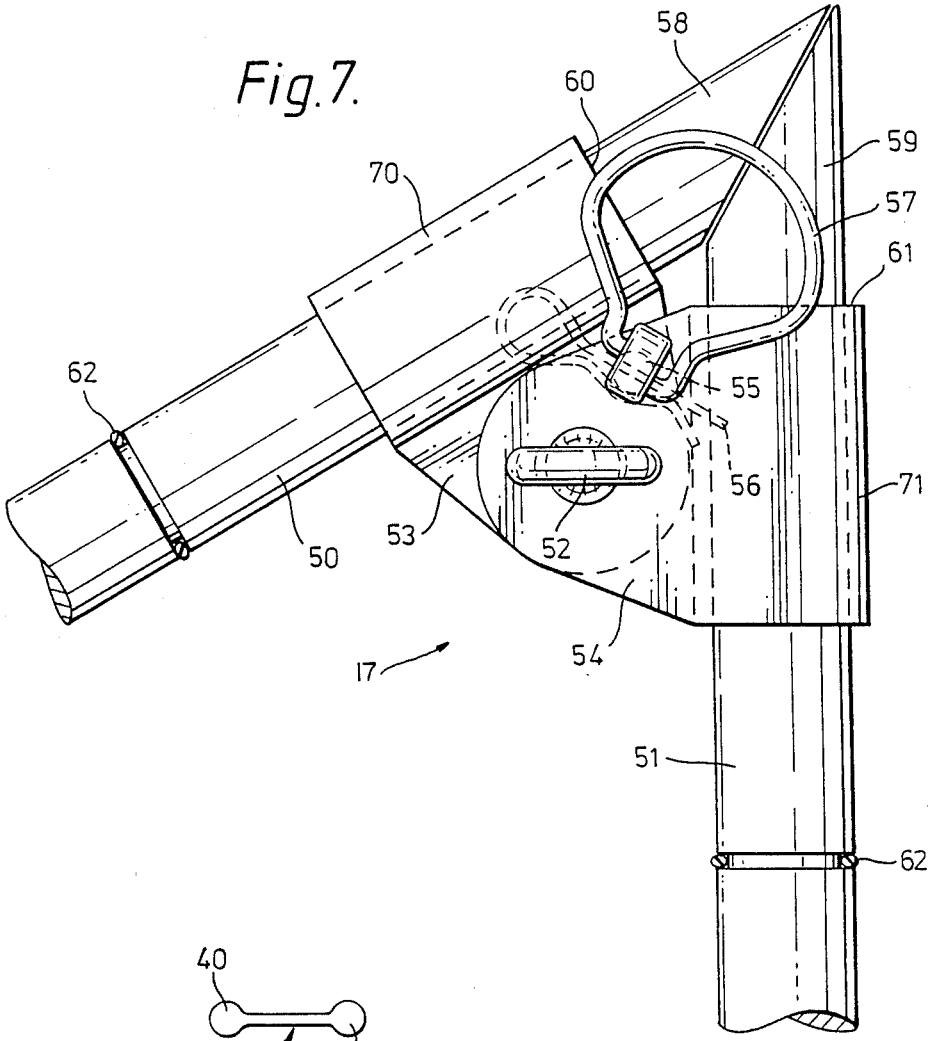
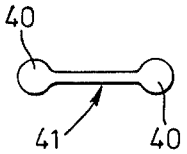
Fig.10.

Fig. 9.
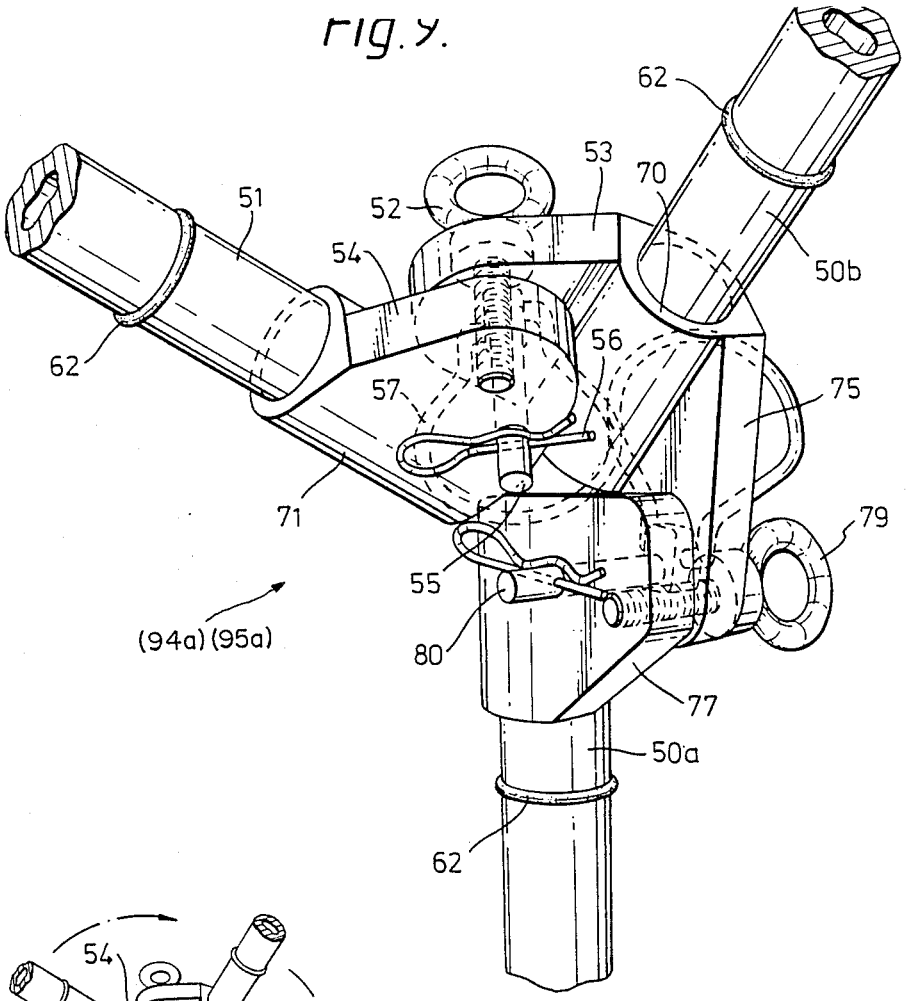
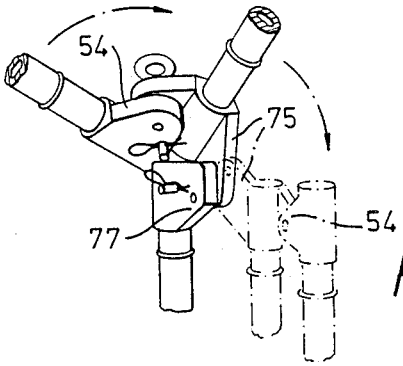
Fig. 11.

BUILDING STRUCTURES

This is a continuation of application Ser. No. 026,762 filed Mar. 2, 1987, now abandoned.

This invention relates to building structures, particularly temporary structures such as marquees, tents, awnings and canopies.

Such structures are generally portable and are erected for particular outdoor occasions or indoor exhibitions. Present structures generally rely upon at least one central pole and/or tensioned anchoring wires or guy ropes for their stability. Moreover, once erected, it is not generally possible to extend or alter the area covered by the structure.

It is an object of the present invention to provide a more versatile and flexible building structure which is easily erected and which can be extended to cover virtually any required area.

According to one aspect of the present invention there is provided a framework module for a modular building structure, the framework comprising a plurality of elongate frame members which, in use, are assembled to form two inverted V-frames oppositely inclined to the vertical, the two frames defining respective faces of first and second imaginary pyramid spaces, the arrangement being such that, when two of the modules are assembled together, one of the inverted V-frames of the second module defines an adjoining face of either the first or second pyramid space defined by the first module.

In this manner the modular units can be assembled to provide any number of complete or partially complete pyramidal structures.

Each module preferably includes a pair of support legs, the legs being assembled with the members of the inverted V-frames to form respective Y-junctions.

The framework is preferably collapsible, the V-frame members at each apex of the framework and at each Y-junction being hinged and/or releasably coupled to one another. Moreover, each frame member may be formed as a continuous section or as a number of sections releasably interlocked with one another.

The framework is preferably covered to provide a generally saddle-shaped canopy with a double curvature, the curvature between the apices being concave, and the curvature from one support leg to the other being convex. When a number of modules are assembled together, the resulting canopy has a striking appearance, particularly when the apices of the pyramids are at different heights.

According to a further aspect of the present invention there is provided a framework comprising an assembly of elongate frame members, at least two of the members extending parallel and closely adjacent to one another, the said two members being joined by a connecting strip having opposed edge formations slidably received in respective complementary grooves extending from one end of the respective member to the other.

The invention will be further described, by way of example only, with reference to the accompanying drawings in which:

FIG. 7 is a plan view of an apex junction in the framework of FIG. 1;

FIG. 9 is a perspective view of an alternative Y-junction;

FIG. 10 is a section through a connecting strip for connecting two adjoining frame members to one another, and FIG. 11 is a simplified representation of FIG. 9 on a reduced scale to illustrate movement of the arms into a collapsed configuration.

Figure 1:
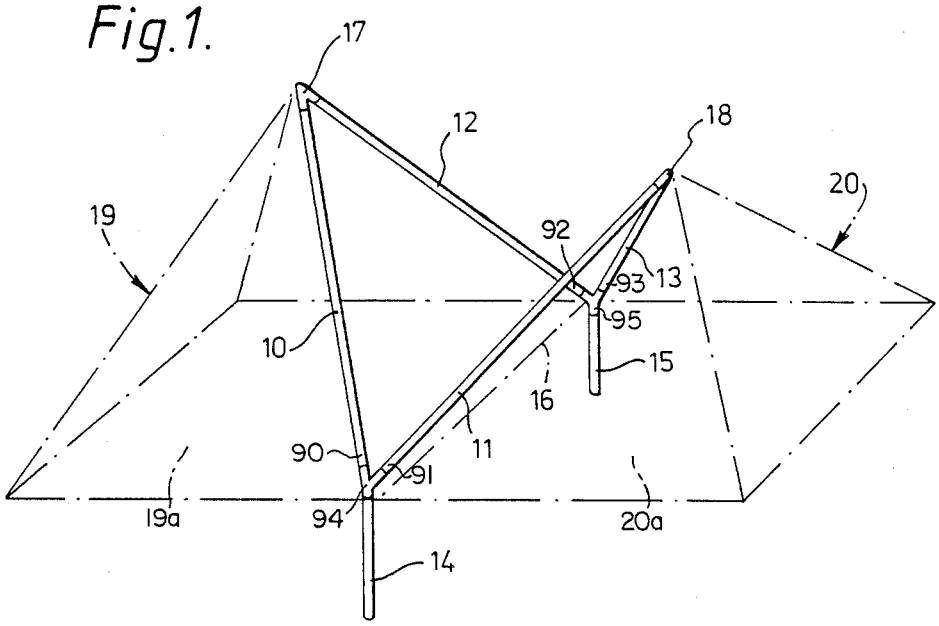
FIG. 1 is a diagrammatic illustration of a framework module embodying the invention.
Figure 3:
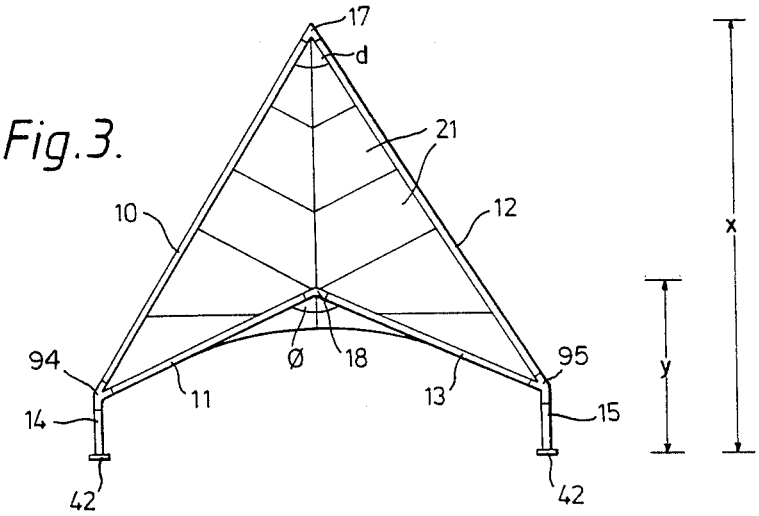
FIG. 3 is an end view of the framework shown in FIG. 1 when fitted with a covering material.
Figure 4:
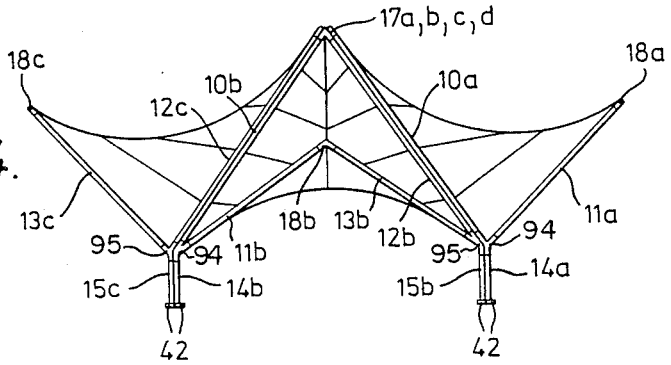
FIG. 4 is a view similar to that of FIG. 3 but on a smaller scale and showing one unit of FIG. 3 assembled with three identical units (one of which is hidden from view) to form a basic module.

Referring first to FIGS. 1 and 3, there is shown a framework consisting of six frame members 10, 11, 12, 13, 14 and 15. The frame members 10 and 12 and the frame members 11 and 13 form respective inverted V-frames which lie in respective planes oppositely inclined to the vertical and intersecting along a common base line 16. The frame members 14, 15 provide legs which support the two inverted V-frames above ground level. Ends 90,91 and 92,93 of the frame members 10, 11, 12, 13 of the two inverted V-frames are joined to one another and to respective legs 14, 15 at joints 94, 95 forming respective V-junctions as seen in FIGS. 1, 3 and 4. Joints 94, 95 are described in detail hereinafter in connection with FIGS. 8, 9 and 11.

The apex 17 of the left hand frame and the apex 18 of the right hand frame coincide with the respective apices of two imaginary pyramid spaces 19, 20 shown in dashed outline, the square base 19*a* of the pyramid spaces 19 being a mirror image of the square base 20*a* of the pyramid space 20. As also described hereafter with reference to FIG. 7, the apices 17 and 18 are at different heights x and y (FIG. 3), with frame members 10 and 12 forming an angle $\alpha$ equal to 60 degrees at apex 17, and with frame members 11 and 13 forming an angle $\phi$ equal to 74 degrees at apex 18.

To provide a canopy or awning, a suitable covering, such as a fabric or glass fibre material, is secured to the frame members 10, 11, 12 and 13, the covering being stretched to provide a double saddle-shaped curvature. As shown in FIG. 3, the material may be divided into brightly coloured stripes 21. A number of such modules can then be assembled to provide a self-supporting canopy of striking appearance.

When assembling any two modules, one of the legs 14,15 of one module is positioned alongside one of the legs of the second module, and one of the remaining frame members 10–13 of the first module is positioned alongside a corresponding member of the second module. The adjoining frame members and legs of the two modules will then mutually support one another and are interconnected by slidably inserting connecting strips 41 between the members, as described hereafter in connection with FIGS. 2 and 10.

In the following description, frame members of the first module are suffixed with the letter 'a', corresponding members of the second module with the letter 'b', and so on.

If, for example, frame member 12b of the second module is positioned alongside frame member 10a, of the first module, as shown in FIG. 4, the frame members 10b, 12b of the second module will define an adjoining face of a pyramid space having its first face already defined by the frame members 10a, 12a. In addition, the frame members 11a, 13a of the first module and the frame members 11b, 13b of the second module will then define respective faces of second and third pyramid spaces each having a base which is a mirror image of the base of the first pyramid space.

Figure 5:
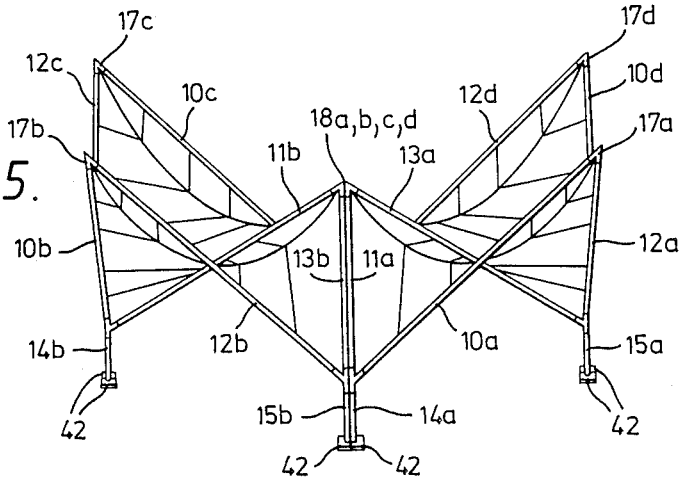
FIG. 5 is a three quarter view showing another possible arrangement of the four units of FIG. 3 assembled to form a basic module.
Figure 6:
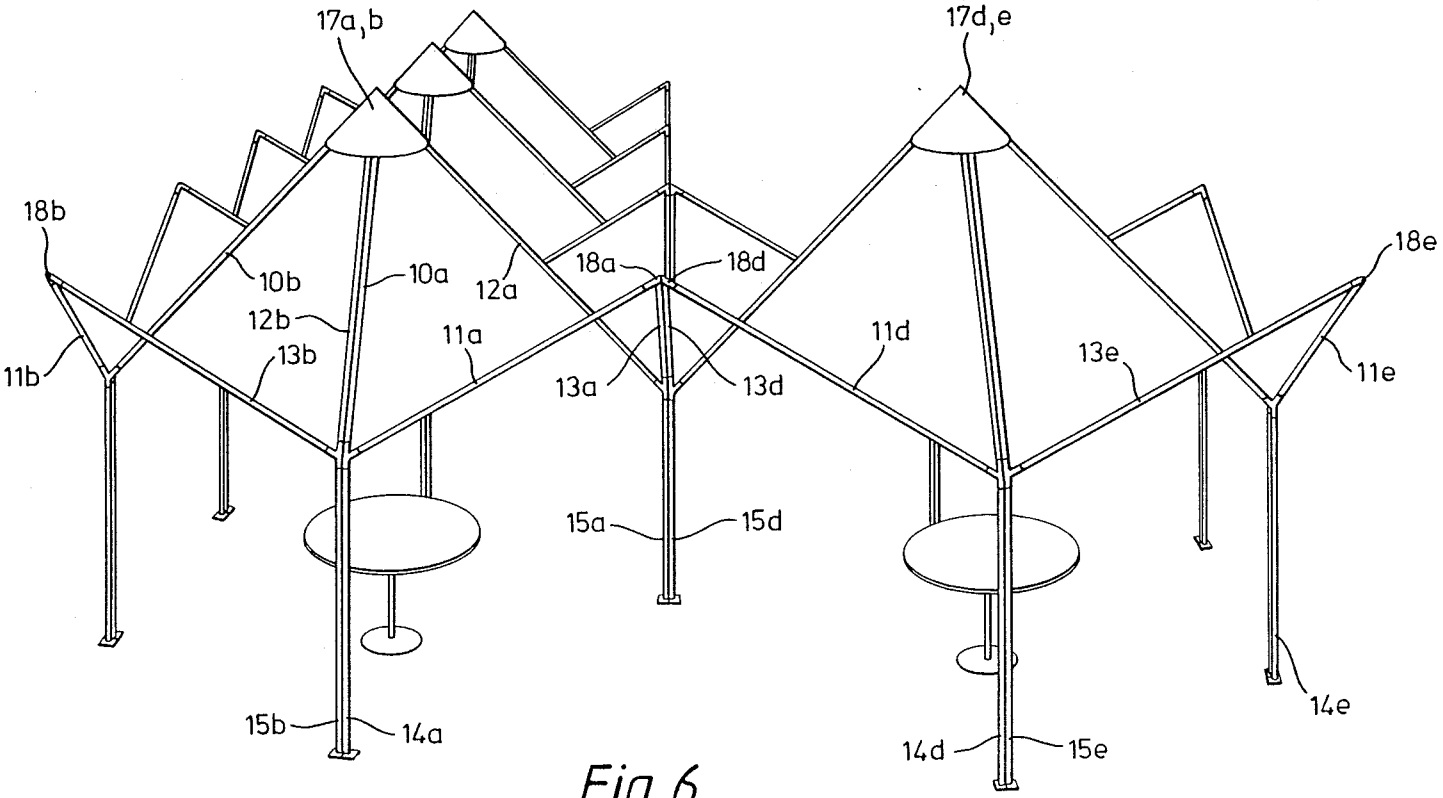
FIG. 6 is a view showing several of the modules of FIG. 4 assembled together.

FIGS. 4–6 show various arrangements which can be built up from the module shown in FIG. 3.

FIGS. 4 and 5 show two alternative units built up from four of the modules shown in FIG. 3, the unit of FIG. 4 having a central apex 17 at a higher level than the four surrounding apices 18a, 18b, 18c and 18d (not visible) while the unit of FIG. 5 has a lower level apex 18 at the centre surrounded by four higher level apices 17a, 17b, 17c and 17d. Accordingly FIG. 4 corresponds to the completion of all four faces of the pyramid 19 in FIG. 1 while FIG. 5 corresponds to the completion of all four faces of the pyramid 20. It can be seen therefore that each unit covers a generally square area corresponding to the base of the respective pyramid.

The basic unit of four modules shown in FIG. 4 can then be further extended in an identical manner by adding additional modules in any desired manner to cover virtually any required area, as shown for example in FIG. 6. The unit shown in FIG. 5 could be similarly extended.

Figure 2:
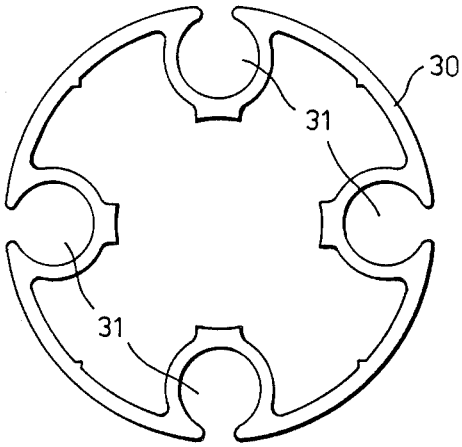
FIG. 2 is a section through one of the frame members in the framework of FIG. 1.

FIG. 2 illustrates a magnified section through one of the frame members 10–15. As shown, each member is a hollow tube extrusion 30 formed with four angularly spaced grooves 31 for slidably receiving either a beaded edge of the covering material or the beaded edge 40 of a connecting strip 41 shown in FIG. 10. The wall of extrusion 30 is reinforced by ribs 32 at the base of each groove 31, the ribs 32 each having an inwardly facing curvature.

Side walls and/or internal walls or partitions may be provided in a similar way using material having beaded edges which are slidably received in respective grooves 31 in the frame members. Alternatively the wall material may be suspended from hooks or eyes carried by runners slidably received in the grooves. The latter arrangement may also be used to secure the bottom edge of the wall or partition to an additional frame member resting on the ground.

As shown in FIG. 10, the connecting strips 41 between adjacent tube extrusions 30 not only hold the structure together but also prevents rain penetration, the strips having opposed beaded edges 40 for insertion in respective grooves 31 of the adjacent extrusions. The strips also provide a desirable degree of flexibility in the overall structure.

The foot of each leg 14, 15, receives a spigot projecting upwardly from a foot plate 42, the leg extrusion and the spigot having vertically spaced holes which can be aligned with a location pin to provide height adjustment.

Referring next to FIG. 7, there is shown a knuckle joint for an apex junction 17. The joint essentially consists of two interconnected parts having respective solid or tubular spigots 50, 51 protruding from sleeves 70, 71, the spigots fitting within the respective tube extrusions 30 (not shown in FIG. 7) being joined, and the two parts being movable between a closed position in which the spigots 50,51 lie essentially parallel to one another and an open position (shown in the figures) in which the spigots are inclined at 60° to one another. The movement is possible because the two sleeves 70, 71 have associated flanges 53, 54 which overlap one another and which are initially joined by a ring bolt 52 engaging aligned threaded holes in each flange. The two parts are then releasably locked in the open position by a locating pin 55 with a retaining clip 56 at the bottom and a pull ring 57 at the top. Inadvertent movement beyond the 60° open position is prevented by angled limit stops 58, 59 projecting from the rear end faces 60, 61 of the sleeves 70, 71.

The spigots 50, 51 are a push-fit in the respective extrusions but may include O-rings 62 to ensure a tight fit.

An identical arrangement is used for the apex 18 except that the apex angle is 74°.

Figure 8:
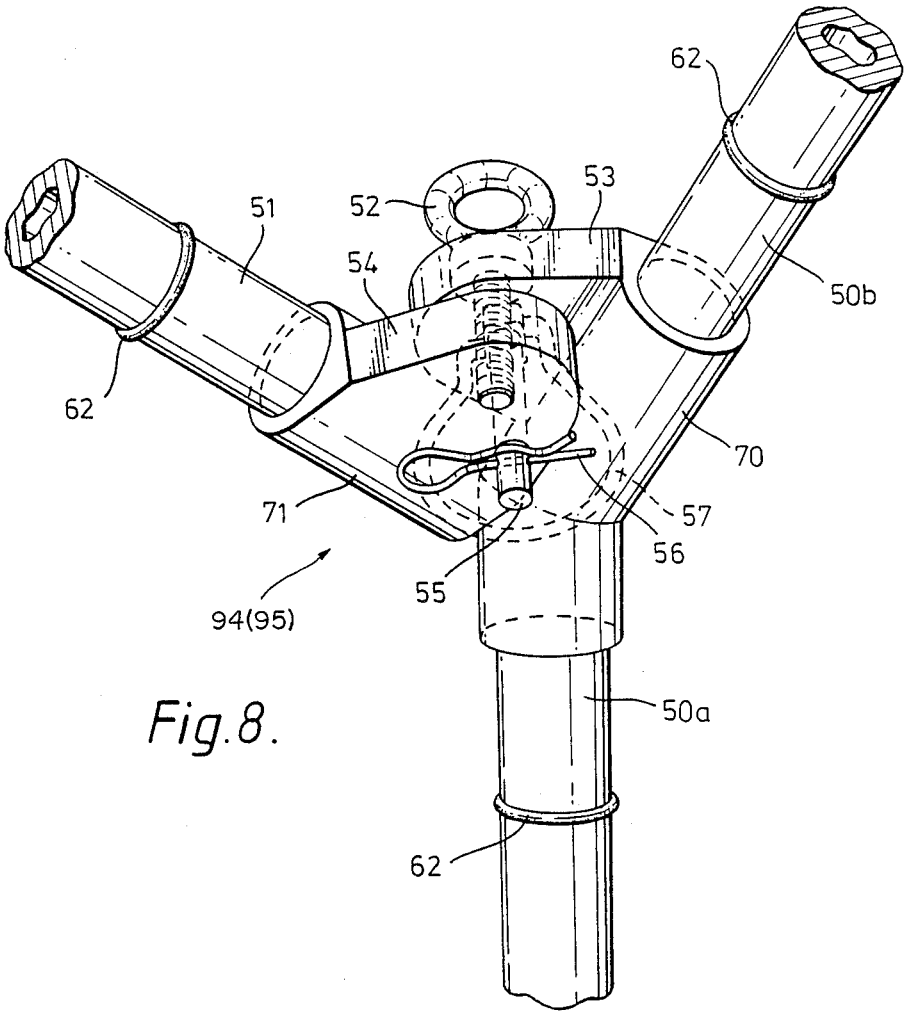
FIG. 8 is a perspective view of a Y junction in the framework of FIG. 1.

A substantially identical jointing arrangement 94 (95) (FIG. 8) is used at the Y-junctions between the legs 14, 15 and the inclined frame members 10, 11 and 12, 13 respectively. In these figures corresponding reference numerals are used to denote parts already described in FIG. 7. In FIG. 8, the sleeve 70 is bent and has two associated projecting spigots 50a and 50b inclined to one another in both horizontal and vertical planes, while the other sleeve 71 has a single projecting spigot 51 releasably locked at a predetermined angle to the spigot 50b but movable into a position parallel with spigot 50b when released by withdrawing the locking pin 55. The spigot 50a fits into a leg 14 or 15, while the spigots 50b and 51 fit into respective frame members 10 and 12 or 11 and 13.

In the alternative Y-junction 94a (95a) illustrated in FIGS. 9 and 11, like parts are again identified by like reference numerals. The main feature of this alternative junction is that the spigot 50a as well as the spigot 51 is hinged to the spigot 50b so that all three spigots can be collapsed into a configuration where the spigots are parallel with one another as shown in FIG. 11. This is achieved by providing the sleeve 70 with a second flange 75 which overlaps a corresponding flange 77 of a sleeve receiving the spigot 50a. The flanges 75, 77 are then connected by a ring bolt 79 and a locking pin 80 in the same manner as the flanges 53, 54.

The structure can be easily erected on almost any terrain without the use of guy ropes or pegs since the system is totally self-supporting.

I claim:

1. A portable building structure for use in tents, awnings, canopies and the like, the building structure comprising an assembly of collapsible framework modules, each module comprising a plurality of elongate frame members and means for assembling the frame members to form two inverted V-frames, a pair of legs for supporting said inverted V-frames thereon, the inverted V-frames lying in planes oppositely inclined to the vertical, each frame member having angularly spaced longitudinal grooves, and a connecting strip for interconnecting adjacent modules and having beaded edges and a flexible covering also having beaded edges, said longitudinal grooves slidably receiving respective beaded edges of said flexible covering and respective beaded edges of said connecting strip, said means for assembling the frame members including a first pair of joints each providing an apex junction for joining the frame members at apices of respective inverted V-frames, and a second pair of joints each forming a Y-junction for joining ends of the two inverted V-frames facing away from said apices to one another and to a respective leg, each of said joints comprising at least two hinge members pivotable between open and closed positions such that the building structure is erectable from a collapsed configuration in which the frame members lie substantially parallel with one another.

2. A portable building structure according to claim 1, wherein the two inverted V-frames of each module define respective triangular faces of two contiguous imaginary pyramid spaces which have bases having the same shape and size such that the spaces are mirror images of each other.

3. A portable building structure according to claim 1, wherein at least one of the frame members of each module is disposed alongside a parallel frame member of an adjacent module such that the modules mutually support one another.

4. A portable building structure according to claim 3, and further comprising elongate strip means having opposed longitudinal beaded edges, the opposed beaded edges being slidably engageable with respective ones of said grooves in adjacent parallel frame members for flexibly interconnecting each two of the said parallel frame members.

5. A portable building structure according to claim 1, wherein the frame members comprise hollow tubular extrusions, and the hinge members of said joints comprise tubular spigots, each spigot being a push-fit in a respective extrusion.

6. A portable building structure according to claim 5, wherein said legs also comprise hollow tubular extrusions, each of said joints forming a Y-junction having a downwardly projecting spigot for engaging a respective leg with a push-fit.

7. A portable building structure according to claim 1 or 5, and further comprising stop means for limiting an opening movement of the hinge members of each joint, and means for releasably locking the hinge members in a fully open position.

8. A portable building structure according to claim 7, wherein the hinge members at an apex of one of the inverted V-frames are releasably locked at a first angle and the hinge members at an apex of another inverted V-frame are locked at a second angle, the first angle being greater than the second angle.

9. A portable building structure according to claim 8, wherein the first angle is approximately 74° and the second angle is approximately 60°.

* * * * *